US010538998B2

(12) United States Patent
Beranger

(10) Patent No.: US 10,538,998 B2
(45) Date of Patent: Jan. 21, 2020

(54) SYSTEM AND METHOD FOR CONTROLLING FLUID FLOW IN A DOWNHOLE COMPLETION

(71) Applicant: Schlumberger Technology Corporation, Sugar Land, TX (US)

(72) Inventor: Kevin Beranger, Algard (NO)

(73) Assignee: SCHLUMERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/092,972

(22) Filed: Apr. 7, 2016

(65) Prior Publication Data

US 2016/0298430 A1 Oct. 13, 2016

Related U.S. Application Data

(60) Provisional application No. 62/144,061, filed on Apr. 7, 2015.

(51) Int. Cl.

| | |
|---|---|
| ***E21B 34/06*** | (2006.01) |
| ***E21B 43/08*** | (2006.01) |
| ***E21B 43/12*** | (2006.01) |

(52) U.S. Cl.

CPC ..... *E21B 43/12* (2013.01)

(58) Field of Classification Search

CPC ..... E21B 43/08; E21B 43/12; E21B 43/14; E21B 34/06; E21B 34/063

See application file for complete search history.

(56) References Cited

U.S. PATENT DOCUMENTS

| | | | | |
|---|---|---|---|---|
| 4,771,829 | A * | 9/1988 | Sparlin | B01D 29/48 166/233 |
| 7,832,473 | B2 | 11/2010 | Pensgaard | |
| 8,011,432 | B2 | 9/2011 | Langlais et al. | |
| 8,752,629 | B2 | 6/2014 | Moen | |
| 2006/0048942 | A1 | 3/2006 | Moen et al. | |
| 2006/0118296 | A1 | 6/2006 | Dybevik et al. | |
| 2013/0299198 | A1* | 11/2013 | Gano | E21B 34/06 166/386 |

* cited by examiner

*Primary Examiner* — David J Bagnell
*Assistant Examiner* — Dany E Akakpo

(57) ABSTRACT

A technique facilitates control over production flow from a well in a manner which increases the longevity of the well. A sand screen assembly or a plurality of sand screen assemblies may be constructed for use in a production operation. Each sand screen assembly comprises a base pipe, a screen, an inflow control device, and a plurality of plugs located between the base pipe and the screen. The plurality of plugs is held initially by corresponding release mechanisms at a position upstream of a bypass. The bypass comprises a plurality of flow passages which route inflowing fluid through the inflow control device and into an interior of the base pipe. The plugs are sized to at least partially plug corresponding flow passages of the bypass upon the occurrence of a trigger event which causes a release mechanism or release mechanisms to release corresponding plugs.

17 Claims, 3 Drawing Sheets

SYSTEM AND METHOD FOR CONTROLLING FLUID FLOW IN A DOWNHOLE COMPLETION

BACKGROUND

Hydrocarbon fluids such as oil and natural gas are obtained from a subterranean geologic formation, referred to as a reservoir, by drilling a well that penetrates the hydrocarbon-bearing formation. In various applications, completion systems are deployed downhole into a wellbore to facilitate production of hydrocarbon-based fluids or other desirable fluids. The completion systems may comprise a plurality of sand screen assemblies which each work in cooperation with an inflow control device through which inflowing fluid enters an interior of an internal base pipe. The fluid may then be produced up through the internal base pipe to the surface. In some hydrocarbon wells, however, water production occurs during the life of the well and the water production can lead to early abandonment of the well.

SUMMARY

In general, a system and methodology are provided for controlling production flow from a well in a manner which increases the longevity of the well. A sand screen assembly or a plurality of sand screen assemblies may be constructed for use in a production operation. Each sand screen assembly comprises a base pipe, a screen, an inflow control device, and a plurality of plugs located in a flow path of fluid flowing in through the screen. The plurality of plugs is held initially by corresponding release mechanisms at a position upstream of a bypass. The bypass comprises a plurality of flow passages which route inflowing fluid to the inflow control device for passage into an interior of the base pipe. The plugs are sized to at least partially plug corresponding flow passages of the bypass upon the occurrence of a trigger event which causes a release mechanism or release mechanisms to release corresponding plugs.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which may be used to control fluid flows in a well. In certain embodiments, for example, the system and methodology may be used to inhibit the influx of water or other undesirable fluids from specific zones along a borehole, thus increasing the longevity of the well. By way of example, a completion may be deployed downhole into a borehole and the completion may comprise a sand screen assembly or a plurality of sand screen assemblies. Each sand screen assembly has a base pipe, a screen, an inflow control device, a bypass, and a plurality of plugs.

The plugs may be located between the base pipe and the screen and initially held by corresponding release mechanisms at a position upstream of the bypass. The bypass comprises a plurality of flow passages which route inflowing fluid to the inflow control device which, in turn, routes the inflowing fluid into an interior of the base pipe. The plugs are sized to at least partially plug corresponding flow passages of the bypass upon the occurrence of a trigger event which causes a release mechanism or release mechanisms to release corresponding plugs.

By way of example, the trigger event may be sufficient degradation of the release mechanisms upon exposure to water over a certain time period. Once sufficient degradation occurs due to the presence of water, the plug(s) held by the corresponding release mechanism(s) is released. The plug(s) is then carried by the inflowing fluid into the corresponding flow passage(s), thus limiting or blocking further influx of water into the inflow control device. However, other techniques may be used to release the plug or plugs upon the occurrence of the trigger event. For example, a magnetic field may be used to hold the plugs and then release them upon a trigger event related to the dragging force of the fluid flow energy or velocity. A variety of electromechanical devices also can be used to selectively hold and release the plugs. In some applications, the release mechanisms may be dissolved or otherwise degraded through the application of a specific fluid, e.g. delivery of an acid downhole to the release mechanisms.

During the life of certain reservoirs, water production occurs at some stage and can lead to early abandonment of a well formed in the reservoir. The plugs and release mechanisms used in cooperation with the bypass enables the influx of water to be limited at specific stages or zones along the well. By limiting the influx of water, the life of the well can be extended.

Figure 1:
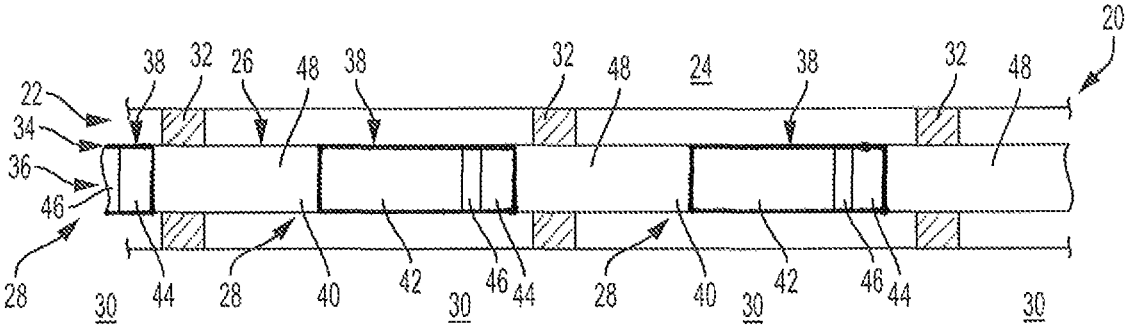
FIG. 1 is a schematic illustration of an example of a well system deployed in a wellbore and comprising at least one screen assembly, according to an embodiment of the disclosure.

Referring generally to FIG. 1, an example of a well system 20 is illustrated as deployed in a borehole 22, e.g. a wellbore. In many applications, the wellbore 22 may be a deviated wellbore, e.g. horizontal wellbore, extending into or through a corresponding formation 24. In this example, the well system 20 comprises a tubing string 26 which may be in the form of a well completion. The tubing string 26 is divided into a plurality of sections or stages 28 which correspond with a plurality of well zones 30. The stages 28 may be isolated via a plurality of packers 32.

In the embodiment illustrated, the tubing string 26 comprises a sand control system 34 which may be used to remove particulates from fluids as they flow from the surrounding formation 24 to an interior 36 of the tubing string 26. The sand control system 34 may comprise an individual sand control assembly 38 or a plurality of sand control assemblies 38 disposed along the tubing string 26. In some embodiments, individual stages 28 of tubing string 26 may each comprise a corresponding sand control assembly 38 which removes particulates from fluid flowing into the tubing string 26 from the corresponding well zone 30.

As illustrated in FIG. 1, each sand control assembly 38 may comprise a base pipe 40, a screen 42 positioned along an exterior of the base pipe 40, an inflow control device 44, and a bypass 46. By way of example, the base pipes 40 may be linked along tubing string 26 by additional tubing sections 48 or the base pipes 40 may be sections of a continuous tubular extending through the plurality of individual stages 28. Additionally, the screen 42 may comprise a variety of screen types including woven and nonwoven screens, slotted pipe screens, direct wire wrap screens, slip-on jacket type screens, and/or other types of screens which enable the passage of fluid, e.g. inflowing production fluid, while filtering out particulates.

In production operations, inflowing production fluid, e.g. oil, passes radially through screen 42 and then flows along an exterior of the corresponding base pipe 40 to the corresponding inflow control device 44. The bypass 46 is positioned upstream of the corresponding inflow control device 44 such that inflowing fluid passes through the bypass 46 before entering inflow control device 44. In some applications, the bypass 46 may be in the form of a bypass ring which encircles the base pipe 40. Once the inflowing fluid moves through the bypass 46, the fluid is directed via inflow control device 44 to the interior 36. The fluid is then routed along interior 36 within tubing string 26 to a desired surface location, collection location, and/or other desired location. The inflow control device 44 may have an appropriate port or ports through which the inflowing fluid is directed from the exterior of base pipe 40 to the interior 36.

Figure 2:
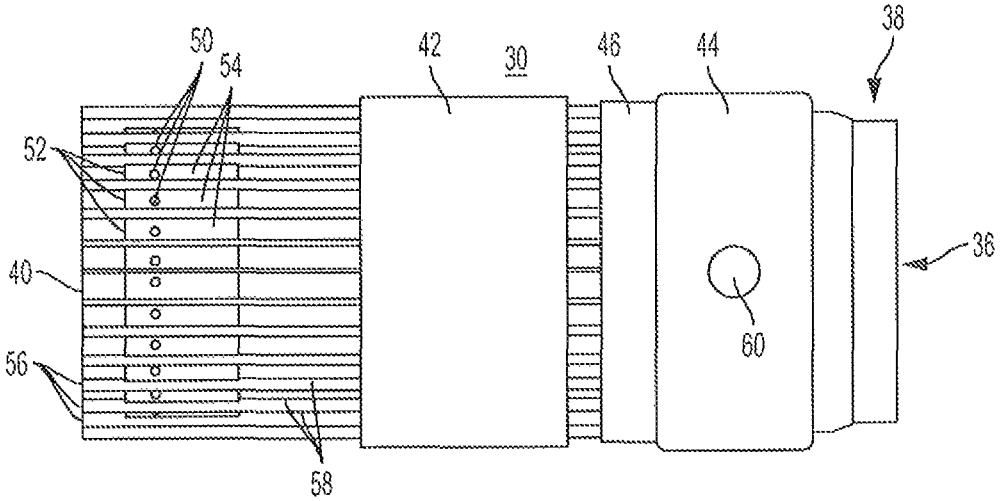
FIG. 2 is an illustration of an example of a screen assembly, according to an embodiment of the disclosure.

Referring generally to FIG. 2, an example of sand control assembly 38 is illustrated. In this example, the sand control assembly 38 comprises a plurality of plugs 50 which are releasably held upstream of the bypass 46, e.g. at a radial position between base pipe 40 and screen 42. It should be noted that FIG. 2 illustrates a portion of the screen 42 so as to show the plugs 50 but the screen 42 may cover the releasable plugs 50. The plugs 50 are initially held at a desired location upstream (with respect to inflowing fluid) of bypass 46 and inflow control device 44 by a release mechanism 52. The release mechanism 52 is constructed to release individual plugs 50 upon the occurrence of a trigger event.

By way of example, the release mechanism 52 may comprise a plurality of release mechanisms 52. According to an embodiment, the plurality of release mechanisms 52 are constructed in the form of degradable members 54, e.g. degradable pads, and the trigger event comprises sufficient degradation of members 54 so as to release corresponding plugs 50. Specific plugs 50 may be released according to which degradable pads 54 are subjected to the sufficient degradation. Depending on the application, the degradation may be induced by certain materials, such as water and/or acid. If the degradable members 54 are degraded by water, the incursion of water into specific sand control assemblies 38 at specific well zones 30 may be used to automatically control release of the plugs 50. If the degradable members 54 are degradable in the presence of a selected acid, the selected acid may be routed downhole via a control line or other flow passage to a specific sand control assembly 38 to provide a controlled release of plugs 50.

However, other types of release mechanisms 52 and other types of degradable members 54 may be utilized. Depending on the application, the release mechanisms 52 may comprise a variety of degradable members 54, e.g. degradable pads, formed of a variety of materials which dissolve or otherwise degrade in the presence of a specific substance to provide a triggering event which releases the plugs 50. For example, the degradable members 54 may be dissolved or otherwise degraded via acid attack, dissolvability in water, and/or degradation via erosion. With respect to degradation via erosion embodiments, the degradable members 54 may be formed from a material which erodes once the screen 42 is damaged and starts to produce sand. In this latter example, the plugs 50 may be formed from a less erodible material, such as carbide tungsten. In some applications, the release mechanisms 52 may be mechanical or may utilize a magnetic field which holds the plugs and then releases them upon a trigger event related to the dragging force of the fluid flow energy or velocity. The release mechanisms 52 also can be constructed to enable electromagnetic triggering via a suitable sensor.

Figure 3:
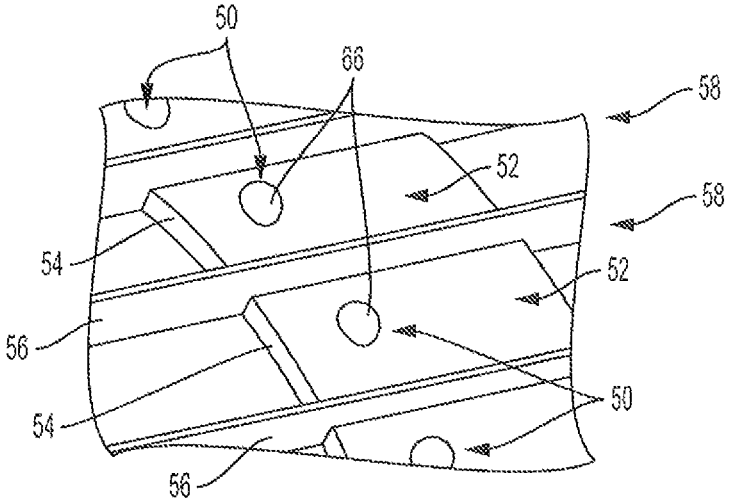
FIG. 3 is an illustration of a portion of an example of a screen assembly having a plurality of plugs initially held by release mechanisms, according to an embodiment of the disclosure.

In the example illustrated, the individual plugs 50 and the corresponding release mechanisms 52 are separated circumferentially by dividers 56, as further illustrated in FIG. 3. The dividers 56 may be arranged longitudinally along an exterior of the base pipe 40 to provide conduits 58, e.g. channels. The conduits 58 guide the plugs 50 to bypass 46 after release of the plugs 50 by release mechanisms 52 upon the occurrence of the trigger event. By way of example, the dividers 56 may comprise wires, strips, or other types of dividers extending generally radially between an exterior of base pipe 40 and an interior of screen 42. In some applications, the dividers 56 are generally axially aligned along the exterior of base pipe 40.

The sizes of plugs 50, release mechanisms 52, and dividers 56 are selected to allow a free flow of inflowing fluid. For example, fluid from a surrounding well zone 30 moves into wellbore 22 and passes radially through screen 42 to the region between screen 42 and base pipe 40. The inflowing fluid may then flow past plugs 50 and release mechanisms 52 as it moves along conduits 58. The inflowing fluid continues to flow through bypass 46, into inflow control device 44, and into interior 36 of base pipe 40 via an appropriate port or ports 60 within inflow control device 44.

Figure 4:
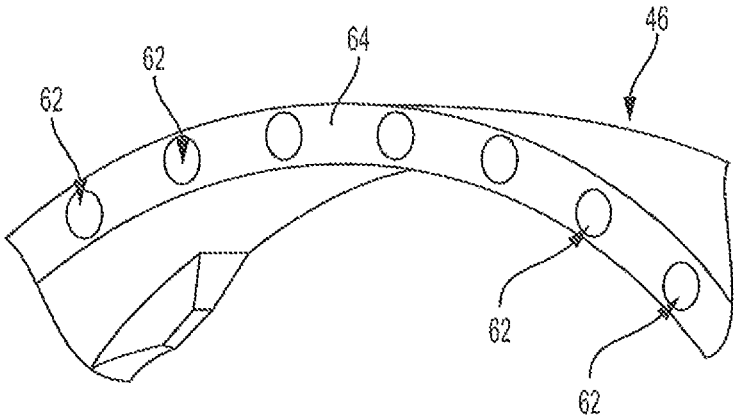
FIG. 4 is an illustration of an example of a bypass having a plurality of bypass flow passages, according to an embodiment of the disclosure.

As illustrated in FIG. 4, the bypass 46 may comprise a plurality of flow passages 62. In the example illustrated, bypass 46 is in the form of a bypass ring 64 having flow passages 62 which correspond with specific conduits 58 and specific plugs 50. The plugs 50 are constructed to flow with the inflowing fluid upon release from release mechanisms 52 so that the plugs 50 flow into and are trapped within the corresponding flow passages 62. The plugs 50 and the corresponding flow passages 62 may be sized and shaped to enable blockage (or at least partial blockage) of flow through the flow passages 62 once plugged via the corresponding plugs 50. In some embodiments, the plugs 50 are in the form of balls 66 (see FIG. 3) which are received and held within corresponding flow passages 62 upon release from the corresponding release mechanisms 52. In some applications, the degradable member(s) 54 and corresponding plug(s) 50 can be positioned so as to enable the plug(s) 50 to directly plug a nozzle of the corresponding inflow control device 44 upon release of the plug(s) 50.

Figure 5:
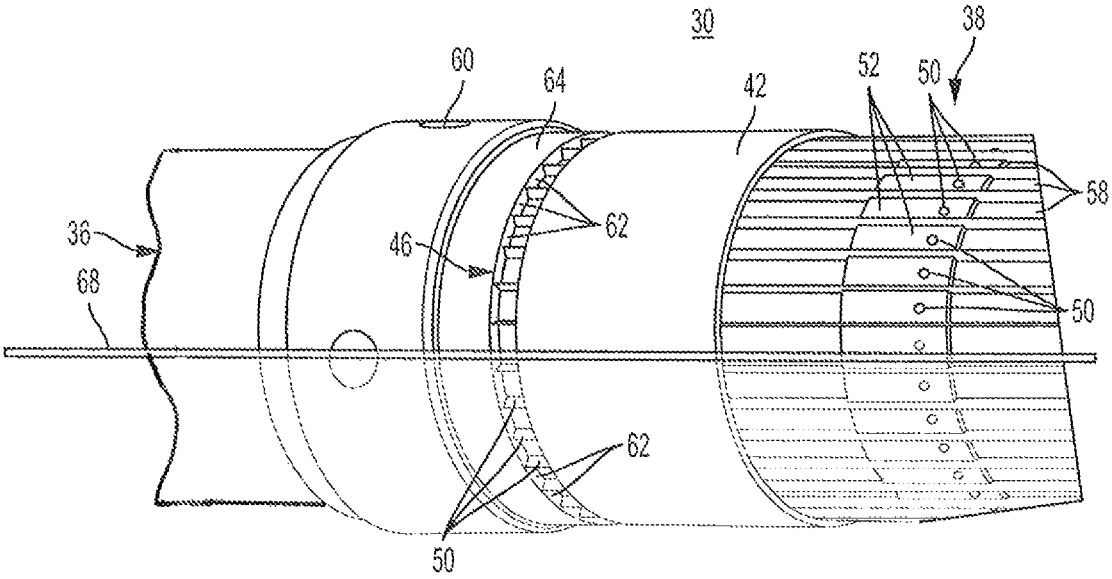
FIG. 5 is an illustration of an example of a screen assembly in which some of the plugs have been released to at least partially plug corresponding flow passages of the bypass, according to an embodiment of the disclosure.

Referring generally to FIG. 5, an operational example of sand control assembly 38 is illustrated. In this example, the release mechanisms 52 are constructed as degradable pads 54 which dissolve in the presence of water. The material of degradable pads 54 may be selected to achieve a desired rate of dissolving such that the degradable pads 54 sufficiently dissolve to trigger the release of plugs 50 over a predetermined period. The predetermined time period may be in the range of, for example, one hour to three months.

As an influx of water into wellbore 22 causes water to rise to a water line 68, the degradable pads 54 beneath the water line 68 dissolve and release the plugs 50. In this example, plugs 50 are in the form of spherical balls 66 which, upon release, are carried by the inflowing fluid along conduits 58 to bypass ring 64. The spherical balls 66 are captured in the corresponding flow passages 62 of the bypass ring 64 and fully (or at least partially) block further flow of water into inflow control device 44. Thus, the flow of water into interior 36 of tubing string 26 is blocked or reduced at that particular well zone 30. However, the release mechanisms 52 which have not been triggered, e.g. which have not been sufficiently degraded due to the presence of water, retain the plugs 50 and prevent them from moving with the inflowing fluid to bypass 46. As illustrated in FIG. 5 the plugs 50, e.g. balls 66, above the water line 68 remain held by the corresponding release mechanisms 52. This enables the desired fluid, e.g. oil, to continue flowing into interior 36 through inflow control device 44.

The trigger event may be specifically selected according to the parameters of a given operation. For example, the trigger event may comprise sufficient dissolving or other degradation of the material forming degradable members 54 so as to release the corresponding plugs 50. The dissolving or other degradation of material may be caused by water or another desired substance such as acid. In this type of embodiment, the material forming degradable members 54 is resistant to degradation in the presence of oil flow and in the presence of particles which may accompany the oil flow. However, the degradable members 54 are dissolvable or otherwise degradable when contacted with certain fluids, e.g. water and/or acid. In some applications, the degradable members 54 may be degradable by water but also degradable by another substance, e.g. acid, so that the other substance, e.g. acid, may be pumped downhole to a specific sand screen assembly 38 to shut down flow through the specific sand screen assembly 38.

The pads or other types of degradable members 54 are constructed to allow fluid to freely flow along conduits 58 prior to release of plugs 50. Additionally, the plugs 50 may be formed from an erosion and corrosion resistant material. This enables the plugs 50 to retain their shape, thus providing the desired plugging of their corresponding flow passages 62 upon release by the corresponding release mechanisms 52.

In production well applications susceptible to unwanted influx of water, the sand control assemblies 38 described herein enable the reduction or shutdown of water influx at specific well zones 30 along the tubing string 26. This ability to release individual plugs 50 in individual sand control assemblies 38 enables the production of oil or other desired fluids at each well zone for longer periods of time without being contaminated by water. Consequently, the production life of the well can be substantially extended.

Depending on the application, many types of plugs 50, release mechanisms 52, and bypasses 46 may be employed in various systems 20, including well systems and other types of flow systems utilizing tubing. In well applications, the plugs 50, release mechanisms 52, and corresponding bypass 46 may be combined with many types of screen assemblies 38 in many types of wells. Numerous types of metals, composites, and other materials may be used to construct the components of the screen assemblies 38.

The release mechanisms 52 may have various configurations and may comprise degradable release mechanisms, magnetic release mechanisms, mechanical release mechanisms, and/or other suitable release mechanisms. Additionally, the plugs 50 may be formed in a variety of materials and shapes. In many applications, the plugs 50 may be spherical in shape to form balls 66 which are sized to be held and trapped in corresponding flow passages 62 when the inflowing fluid carries the released balls 66 to the corresponding flow passages 62. The bypass 46 also may be constructed in a variety of sizes and shapes and from a variety of materials. In some applications, the bypass 46 may encircle the base pipe 40 to form bypass ring 64. The number, size and spacing of flow passages 62 also may be adjusted according to the parameters of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a sand control system having a plurality of sand control assemblies separated by a plurality of packers, each sand control assembly comprising:

a base pipe;

a screen positioned along an exterior of the base pipe;

an inflow control device;

a bypass ring having flow passages positioned such that fluid flowing inwardly through the screen passes through the flow passages before entering an interior of the base pipe via the inflow control device;

a plurality of plugs disposed between the base pipe and the screen, the plugs each being sized to plug a corresponding flow passage in the bypass ring; and a plurality of degradable pads disposed adjacent an exterior of the base pipe, wherein the plurality of degradable pads individually hold the plurality of plugs away from the flow passages in the bypass ring until a triggering event, wherein the degradable pads are separated by axially aligned dividers which create conduits along which the plugs travel in response to the triggering event until the plugs are stopped upon plugging corresponding flow passages in the bypass ring, wherein the axially aligned dividers extend radially between the exterior of the base pipe and an interior of the screen.

2. The system as recited in claim 1, wherein the plurality of plugs comprises a plurality of balls.

3. The system as recited in claim 1, wherein the degradable pads degrade in the presence of water to trigger release of corresponding plugs of the plurality of plugs.

4. The system as recited in claim 1, wherein the degradable pads degrade in the presence of acid to trigger release of corresponding plugs of the plurality of plugs.

5. The system as recited in claim 1, each degradable pad holding a corresponding plug until release of the corresponding plug is triggered by sufficient degradation of the degradable pad.

6. The system as recited in claim 1, wherein each plug is individually releasable upon sufficient degradation of a corresponding degradable pad.

7. The system as recited in claim 1, wherein the degradable pads are formed from a material which dissolves.

8. The system as recited in claim 1, wherein the bypass ring encircles the exterior of the base pipe.

9. A method, comprising:

coupling an inflow control device to a base pipe to control flow of a fluid between an exterior of the base pipe and an interior of the base pipe;

positioning a screen along the exterior of the base pipe such that an inflow of the fluid is able to flow through the screen and into the interior of the base pipe via the inflow control device;

orienting a bypass such that flow passages in the bypass receive the inflow of the fluid prior to entering the interior of the base pipe via the inflow control device;

locating a plurality of plugs at least partially within a plurality of degradable pads between the screen and the base pipe, the plurality of plugs being sized to block flow through the flow passages in the bypass if released to the flow passages in the bypass, wherein the degradable pads are separated by axially aligned dividers which create conduits along which the plugs travel if released from the degradable pads, and wherein the axially aligned dividers extend radially between the exterior of the base pipe and an interior of the screen; and holding the plurality of plugs with the plurality of degradable pads away from the flow passages in the bypass until the plurality of degradable pads degrade to release individual plugs to flow toward the flow passages in the bypass.

10. The method as recited in claim 9, wherein positioning the screen comprises positioning a wire screen.

11. The method as recited in claim 9, wherein orienting comprises orienting a bypass ring that encircles the exterior of the base pipe.

12. The method as recited in claim 9, wherein locating comprises locating a plurality of balls.

13. The method as recited in claim 9, wherein the plurality of degradable pads are configured to dissolve in the presence of water.

14. A system, comprising:

a sand screen assembly having a plurality of plugs trapped between a base pipe and a screen, the plurality of plugs being held by a plurality of degradable pads upstream of flow passages in a bypass, which routes inflowing fluid through bypass flow passages to an inflow control device mounted along an exterior of the base pipe, the plugs being sized to at least partially plug the bypass flow passages upon release into the inflowing fluid, wherein the plurality of degradable pads are separated by a plurality of axially aligned dividers which create conduits along which the plugs travel toward the bypass flow passages, and wherein the axially aligned dividers extend radially between the exterior of the base pipe and an interior of the screen.

15. The system as recited in claim 14, wherein the plurality of plugs comprises a plurality of balls.

16. The system as recited in claim 15, wherein the plurality of degradable pads secure the plurality of balls until sufficient degradation of the plurality of degradable pads occurs.

17. The system as recited in claim 14, wherein the bypass comprises a bypass ring that encircles the exterior of the base pipe.

* * * * *